US006532376B1

(12) United States Patent
Zhou

(10) Patent No.: US 6,532,376 B1
(45) **Date of Patent: *Mar. 11, 2003**

(54) SWITCHABLE LOW-PASS SUPERCONDUCTIVE FILTER

(75) Inventor: Shu-Ang Zhou, Älvsjö (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/353,648

(22) Filed: Jul. 15, 1999

(30) Foreign Application Priority Data

Jul. 17, 1998 (SE) ..... 9802584

(51) Int. Cl.[7] ..... H01P 1/203; H01B 12/02

(52) U.S. Cl. ..... 505/210; 333/99.005; 333/204; 333/205

(58) Field of Search ..... 333/995, 204, 333/205, 238, 246; 505/700, 701, 866, 210

(56) References Cited

U.S. PATENT DOCUMENTS 6,041,245 A 3/2000 Mansour ..... 333/204 X

OTHER PUBLICATIONS

Lentz, J.J. ; "Transmission Line M Derived Section"; *IBM Technical Disclosure Bulletin*; vols, No. 2 ; Jul 1962 ; p. 21.

*Primary Examiner*—Benny T. Lee
(74) *Attorney, Agent, or Firm*—Nixon & Vanderhye P.C.

(57) ABSTRACT

A low-pass or band-rejection filter for microwave frequencies has a substantially planar structure and is constructed of a transmission line having inductor portions and wider capacitance portions. The inductor portions are designed as linear microstrip elements having widths being varied by making areas at the sides of the linear elements superconducting. In changing the widths of the transmission line also the inductances thereof are changed accordingly. The areas at the sides of the microstrip elements include rather narrow areas located directly at the central, normal metal conductor. These narrow areas have in the non-superconducting state some electrical conductivity which can be small but still not quite insignificant in relation to that of the metal conductor. However, due to the fact that they contact the normal metal conductor only at very narrow edges instead of contacting it at a large surface they do not significantly affect the transmission characteristics of the transmission line in the normal state of the areas which can be made superconducting.

20 Claims, 1 Drawing Sheet

SWITCHABLE LOW-PASS SUPERCONDUCTIVE FILTER

The present invention relates to a microwave filter to be used in microwave integrated circuits, in particular a band rejection or low-pass filter.

BACKGROUND OF THE INVENTION

In transmission paths in microwave integrated circuits there is of course a need for filtering elements. In particular there may be a need for filters the characteristics of which can be varied, such as a filter having a filtering effect only for a specific state of a control signal. Very compact microwave filters can be built using high-temperature cuprate superconductors using e.g. planar stripline structures. Such filters are used in high-performance radio communication systems, e.g. as microwave receiving filters for radio base stations, in which filter having very sharp skirts and low insertion losses as well as small sizes and small weights which are important.

In the Japanese patent application JP 2/101801, a microwave band-rejection filter is disclosed having transmission lines designed as linear microstrip, metal elements placed on top of an area of a layer of superconducting material. The superconducting material area has a pattern substantially agreeing with that of the metal conductor, except in some regions where the width of the superconducting area is larger than that of the metal conductor. When the superconducting material is in a non-superconducting state, most of the electric current passes through the common metal material of the metal conductor, whereas, in superconducting state, the electrical current passes only through the superconducting underlying material. The microstrip metal elements thereby obtain a variable filtering effect. However, a disadvantage of this design resides in providing a region having some, though it may be low, electrical conductivity placed under the normal conductor, since this region causes losses in the transmission line. The conductivity of materials, which are superconducting at a low temperature and are suitable for microwave integrated circuits, have in their normal state an electrical conductivity corresponding to some $10^{-3}$ to $10^{-2}$ times that of the electrical conductivity of the material of the always normal metal conductor.

SUMMARY OF THE INVENTION

It is an object of the invention to provide a switchable filter based on a microstrip transmission line for microwaves, the filter exhibiting low losses.

Thus, a low-pass or band-rejection filter for e.g. microwave frequencies is designed as a substantially planar structure and is constructed of transmission lines designed as linear microstrip elements which have widths which are varied by making areas at the sides of the linear elements superconducting. In changing the widths of the transmission lines also the inductances thereof are changed accordingly. The areas at the sides of the microstrip elements comprise rather narrow areas located directly at the central, normal metal conductor and are thus electrically connected thereto along at least portions of the sides or of the edges of the central microstrip elements. These narrow areas have in the non-superconducting state some electrical conductivity which can be small but still not quite insignificant in relation to that of the metal conductor. However, due to the fact that they contact the central, always normal metal conductor only at very low or thin edges thereof instead of contacting it at a large surface they do no significantly affect the transmission characteristics of the transmission path in the normal state of those areas which can be made superconducting. The transmission lines also comprise capacitance areas which contribute to their capacitance. The capacitance areas project laterally from central stem elements of the transmission lines and are portions of the central, normal metal conductor and are thus made from a normal electrically conducting material which can not be made superconducting at the considered temperatures.

Additional objects and advantages of the invention will be set forth in the description which follows, and in part will be obvious from the description, or may be learned by practice of the invention. The objects and advantages of the invention may be realized and obtained by means of the methods, processes, instrumentalities and combinations particularly pointed out in the appended claims.

BRIEF DESCRIPTION OF THE DRAWINGS

While the novel features of the invention are set forth with particularly in the appended claims, a complete understanding of the invention, both as to organization and content, and of the above and other features thereof may be gained from and the invention will be better appreciated from a consideration of the following detailed description of non-limiting embodiments presented hereinbelow with reference to the accompanying drawings, in which:

DETAILED DESCRIPTION OF CERTAIN EMBODIMENTS OF THIS INVENTION

Figure 1:
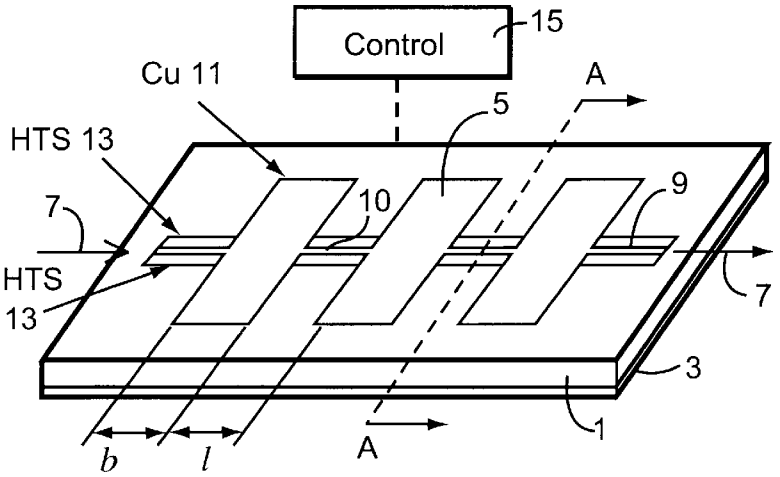
FIG. 1 is a perspective view of a planar, switchable microwave filter structure.
Figure 2:
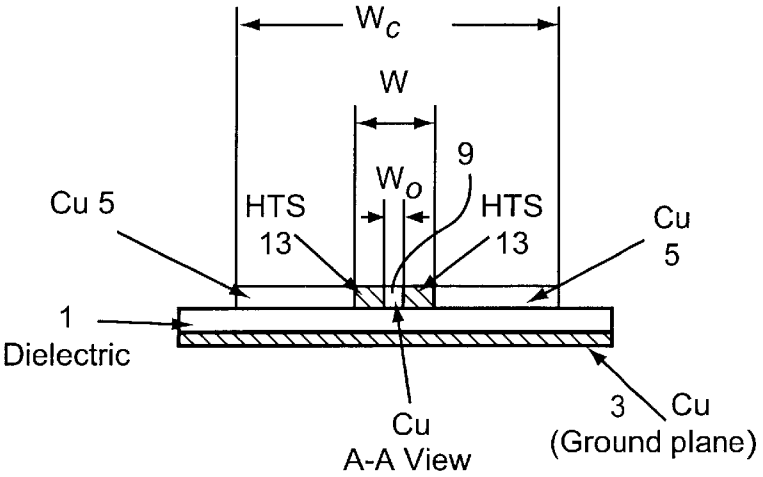
FIG. 2 is a cross-sectional view of the structure of FIG. 1.

In the planar microstrip line element illustrated in FIGS. 1 and 2 a dielectric substrate 1 is used having an electrically conducting ground layer 3, such as a metal layer of e.g. Cu, Ag or Au, on its bottom surface, the ground plane layer covering substantially all of the bottom surface as a contiguous layer. On the top surface there is a patterned electrically conducting layer 5 suitably made of metal, e.g. of the same metal as the bottom layer, i.e. of copper (Cu), silver (Ag) or gold (Au). The patterned layer 5 forms a transmission or propagation path intended for microwaves travelling e.g. in the direction of the arrows 7 (see FIG. 1). The patterned layer 5 has an outline comprising both a central stem path 9 having a uniform, rather narrow shape of width $W_o$ (see FIG. 2) defining the propagation directions and further having lateral extensions 11 of length b as shown in FIG. 1, all having the same rectangular shape, extending laterally from the central stem, one extension being located opposite an identical one to form a larger rectangle having width $W_c$ (see FIG. 2). The lateral extensions are thus located symmetrically in relation to the axis of the central stem and they are furthermore arranged with a uniform spacing along the stem, so that there is a gap length of 1 between the extensions 11, this gap length then being the length of the stem portions 10 between the extensions as shown in FIG. 1.

Figure 3:
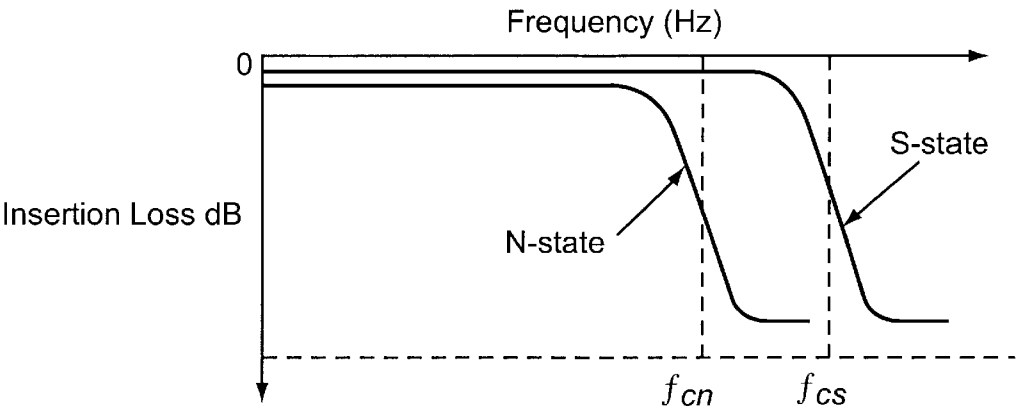
FIG. 3 is a diagram of the insertion loss of a filter structure according to FIGS. 1 and 2 as a function of the microwave frequency.

This structure defines a cut-off frequency $f_{cn}$ of a microwave propagating along the filter. The cut-off frequency appears from the diagram of FIG. 3 illustrating the insertion loss in dB of the microstrip element of FIGS. 1 and 2 as a function of the frequency in Hz of a microwave passing through the microstrip structure. The respective different portions of the structure mainly contribute to either the inductance L or the capacitance C thereof and thereby define the cut-off frequency $f_{cn}$, since it generally is proportional to $(LC)^{-1/2}$. Thus, the size of the lateral extensions 11 primarily defines the capacitance of the filter element and the narrow stem portions 10 of the central stem 9 between the extensions 11, in particular their width, primarily define the inductance L.

The inductance L of the filter element is changed by adding electrically conducting areas or regions 13 directly at the side or sides of the normal conductor pattern 5 at selected places. These regions 13 are made of a superconducting material, preferably a high temperature superconducting (HTS) material. The regions 13 are preferably located at both sides of the central stem portions 10. All of the electrical current will then pass, when these lateral superconducting areas 13 are in a superconducting state (S-state), only in these areas according to the Meissner effect which will reduce the inductance of the transmission path in the filter structure. In the normal state (N-state) of the superconducting material of the lateral areas 13 these areas do not too much disturb the current distribution in the always normal central stem portions since in the normal state of the areas 13 they have, for typical high temperature superconductivity materials, an electrical conductivity ($\sigma_n$ of about $5 \cdot 10^5$ S/m to be compared to the electrical conductivity $\sigma_n$ of the material of metal areas 10, 11 comprising about $10^8$ S/m. For a suitable choice of the resulting width W (see FIG. 2) of stem portions 10 together with the superconducting regions 13 the inductance L of the filter element can be considerably reduced resulting in a higher cut-off frequency $f_{cs}$, see FIG. 3.

A switching between the superconducting state and the normal state of the regions 13 can be achieved in any conventional way, such as by varying the temperature, the magnetic field or a direct current level as to what is required or desired. This switching is symbolized by the control unit 15 shown in FIG. 1. A preferred way may be to have a control making an electrical current higher than the critical current of the superconducting pass or not pass through the microstrip line. By always providing a fixed bias current, thus a direct current, to pass through the line, the fixed bias current having an intensity slightly less than that of the critical current, and adding or not adding thereto a small control current such as a current pulse, the reversible switching between the superconducting state and the normal state can be made extremely fast. Numerical simulation has indicated that the inductance L of a microstrip line can easily be reduced to half its value for a suitable width of the superconducting value. The corresponding relative shift of the cut-off frequency $((f_{cs}-f_{cn})/f_{cn})$ will then have an estimated value of about 40%.

While specific embodiments of the invention have been illustrated and described herein, it is realized that numerous additional advantages, modifications and changes will readily occur to those skilled in the art. Therefore, the invention in its broader aspects is not limited to the specific details, representative devices and illustrated examples shown and described herein. Accordingly, various modifications may be made without departing from the spirit or scope of the general inventive concept as defined by the appended claims and their equivalents. It is therefore to be understood that the appended claims are intended to cover all such modifications and changes as fall within a true spirit and scope of the invention.

What is claimed is:

1. A filter structure for microwaves, the filter structure comprising:

a central microstrip line comprising an electrically conducting material exhibiting no superconducting properties above a given temperature, said central microstrip line transmitting mircrowaves and having an input end for receiving incoming microwaves and an output end for outputting microwaves; and superconducting regions comprising a material exhibiting superconducting properties above the given temperature, the regions being located at sides of the central microstrip line and in the same plane as the central microstrip line so that at least one of the superconducting regions and at least one adjacent portion of the central microstrip line only contact one another along respective edges thereof.

2. The filter structure of claim 1, wherein at least some of the regions have shapes of strips of uniform widths.

3. The filter structure of claim 2, wherein all regions have a same width.

4. The filter structure of claim 1, wherein the central microstrip line has lateral extensions extending from a central stem.

5. The filter structure of claim 4, wherein the central stem has a substantially uniform width.

6. The filter structure of claim 4, wherein all lateral extensions have substantially a same shape.

7. The filter structure of claim 4, wherein at least some of the lateral extensions have substantially rectangular shapes.

8. The filter structure of claim 4, wherein all the lateral extensions are uniformly distributed along the central stem.

9. The filter structure of claim 4, wherein all the regions are placed at sides of portions of the central stem between the lateral extensions.

10. The filter structure of claim 1, wherein the central microstrip line and the regions are shaped in a manner such that the filter structure is substantially symmetric about a longitudinal axis of the central microstrip line.

11. The filter structure of claim 1, further comprising control means for selectively causing electrical current to flow through the regions, thereby bringing, when the filter structure is above the given temperature and the regions are in a superconducting state, the regions to change to a non-superconducting state.

12. The filter structure of claim 1, wherein the superconducting regions comprise two strip-shaped superconducting regions on the substrate in the same plane as the microstrip line, one of the two strip-shaped superconducting regions being located at and in contact with the microstrip line along a first side of the microstrip line, and the other of the strip-shaped superconducting regions being located at and in contact with the microstrip line along an opposite second side of the microstrip line.

13. The filter structure of claim 1, further comprising conductive lateral extensions which are integral with the central microstrip line, wherein the lateral extensions extend peripherally beyond the superconducting regions, and the superconducting regions are not provided at locations along the central microstrip line where the lateral extensions are located.

14. A microwave filter structure comprising:

a central microstrip line including an electrically conductive material exhibiting no superconducting properties above a given temperature, said central microstrip line for transmitting microwaves and having an input end for receiving incoming microwaves and an output end for outputting microwaves;

superconducting regions comprised of a material exhibiting superconducting properties above the given temperature, the regions being located at sides of the central microstrip line and in the same plane as the central microstrip line so that abutting edges thereof contact one another; and a controller for selectively causing electrical current to flow through the regions, thereby causing, when the filter structure is above the given temperature and the regions are in a superconducting state, the superconducting regions to change to a non-superconducting state.

15. The filter structure of claim 14, further comprising conductive lateral extensions which are integral with the central microstrip line, wherein the lateral extensions extend peripherally beyond the superconducting regions, and the superconducting regions are not provided at locations along the central microstrip line where the lateral extensions are located.

16. The filter structure of claim 14, wherein the superconducting regions comprise two strip-shaped superconducting regions on the substrate in the same plane as the microstrip line, one of the two strip-shaped superconducting regions being located at and in contact with the microstrip line along a first side of the microstrip line, and the other of the strip-shaped superconducting regions being located at and in contact with the microstrip line along an opposite second side of the microstrip line.

17. A method of regulating an inductance of an microstrip line including a substrate, electrical conducting material, for transmitting microwaves, disposed on the substrate, and superconductive regions disposed on the substrate adjacent to and in a same plane as the microstrip line, the method comprising:

causing microwaves to be transmitted along a transmission or propagation path defined by the electrical conducting material of the microstrip; and changing an effective width of the microstrip line by changing a state of the superconductive regions, thereby changing the inductance of the microstrip line.

18. The method in claim 17, wherein the state is a superconductivity state.

19. The method in claim 17, further comprising lowering the inductance by changing the state to a superconductive state and raising the inductance by changing the state to a non-superconductive state.

20. The method in claim 19, wherein the change is accomplished by varying a temperature associated with the superconductive regions.

* * * * *